United States Patent [19]

Konrath et al.

[11] 4,334,514

[45] Jun. 15, 1982

[54] FUEL INJECTION PUMP FOR INTERNAL COMBUSTION ENGINE

[75] Inventors: Karl Konrath, Ludwigsburg; Gerhard Brink, Stuttgart, both of Fed. Rep. of Germany

[73] Assignee: Robert Bosch GmbH, Stuttgart, Fed. Rep. of Germany

[21] Appl. No.: 173,514

[22] Filed: Jul. 30, 1980

[30] Foreign Application Priority Data

Aug. 7, 1979 [DE] Fed. Rep. of Germany ..... 2931938

[51] Int. Cl.[3] ..... F02M 59/32

[52] U.S. Cl. ..... 123/502; 123/465; 123/501

[58] Field of Search ..... 123/502, 501, 459, 465, 123/380, 357

[56] References Cited

U.S. PATENT DOCUMENTS

| | | | |
|---|---|---|---|
| 2,888,000 | 5/1959 | Winkler | 123/465 |
| 2,988,077 | 6/1961 | Hottenroth | 123/459 |
| 3,330,261 | 7/1967 | Jackson | 123/465 |
| 4,014,305 | 3/1977 | Skinner | 123/502 |
| 4,220,128 | 9/1980 | Kobayashi | 123/502 |
| 4,228,773 | 10/1980 | Stumpp | 123/459 |

*Primary Examiner*—Charles J. Myhre
*Assistant Examiner*—Carl Stuart Miller
*Attorney, Agent, or Firm*—Edwin E. Greigg

[57] ABSTRACT

A fuel injection pump having a hydraulic adjuster for the instant of injection is proposed, in which in addition to the rpm-proportional adjustment of the onset of injection, a supplementary variation of the onset of injection occurs in accordance with pressure related to altitude.

6 Claims, 3 Drawing Figures

FUEL INJECTION PUMP FOR INTERNAL COMBUSTION ENGINE

BACKGROUND OF THE INVENTION

The invention is related to a fuel injection pump as described by the preamble to the main claim. In a known fuel injection of this type, the pressure variation which is characteristic for the onset of injection is effected by means of engine characteristics, which has particular advantages in the case of starting an internal combustion engine when it is cold. A variation of the external air pressure is well-known to involve substantial difficulties in meeting the increasingly stringent requirements for substantially nontoxic exhaust gas, and these difficulties cannot be solved with the known means of pump control.

OBJECT AND SUMMARY OF THE INVENTION

The fuel injection, according to the invention, having the characteristics of the main claim, has the advantage of the prior art that an exhaust gas quality, once established, can continue to be maintained in a simple manner and, in particular, in a modular system (that is, one which can be subsequently installed), by means of an adjustment of the instant of the injection when there is a variation in pressure as a result of altitude. By means of varying the valve spring initial tension, the system functions as a closed-loop control system with respect to the quality of combustion.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
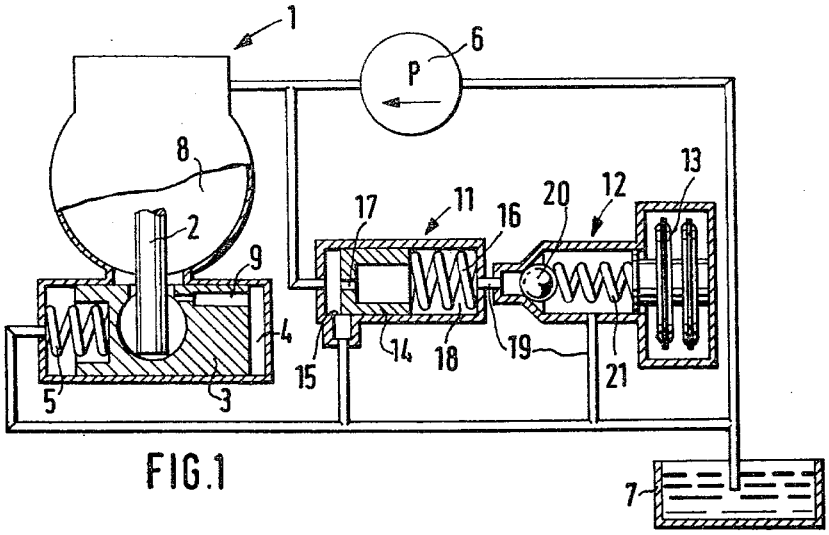
FIG. 1 is a schematic drawing of the injection pump having closed-loop control of the onset of injection.

Turning now to the drawing an adjusting system 3 is adapted to engage the cam drive of a fuel injection pump 1 via a pin 2 for the adjustment of the instant of the onset of the injections. The adjusting system 3 is displaceable counter to a restoring spring 5 by means of a pressure fluid located in a work chamber 4; the further the piston is displaced toward the spring, the more the instant of injection is displaced toward "early" with respect to top dead center of the engine system. A supply pump 6 aspirates fuel from a fuel container 7 and delivers it into a suction chamber 8 of the injection pump 1, from which (not shown in further detail) the actual fuel injection pump is supplied with fuel and which communicates with the work chamber 4 via a bore 9 in the injecting system 3. The supply pressure of the supply pump 6 and thus the pressure in the suction chamber 8 is controlled in accordance with rpm via a pressure control valve 11, the pressure increasing proportionally with increasing rpm. This rpm-dependent pressure thus also prevails in the work chamber 4, so that with increasing rpm and thus increasing pressure the injection adjusting piston 3 is displaced toward "early".

Figure 2:
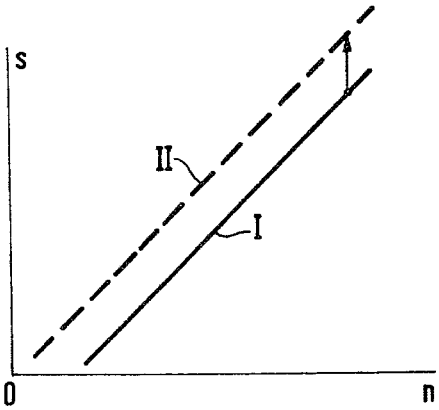
FIG. 2 is a functional diagram.

In FIG. 2, a diagram is given in which the stroke s (ordinate) of the adjustment piston is plotted over the rpm n (abscissa). The line representing the injection adjustment for which the stroke and thus the early adjustment increases linearly with the rpm is designated by I. A line extending parallel thereto is designated II, and the course of the injection onset represented thereby would be necessary if the engine were driven at an altitude of 2,200 meters. The necessary adjustment of injection onset would necessitate a change of three angular degrees in the direction of "early".

In accordance with the invention, this is obtained by influencing the pressure in the suction chamber 8 and thus in the work chamber 4 via a pressure maintenance valve 12, which is controllable via a barometric box 13. The pressure control valve 11 has a piston 14, with which the spill port 15 is controllable and which is displaceable counter to a control spring 16 by means of the supplying fuel of the supply pump 6. The control system 14 has a throttle bore 17, by means of which the chambers on the two end faces are connected. The spring chamber 18 which encloses the control spring 16 has a discharge channel 19, in which the pressure maintenance valve 12 is disposed. The pressure maintenance valve 12, in turn, has a movable valve member 20, which is engaged by a valve spring 21. On the side remote from the valve member 20 the valve spring 21 is supported by the barometric box 13 which here comprises two diaphram boxes by means of which the initial tension of the valve spring 21 can be varied.

The functioning of this arrangement is such that at a pressure of approximately sea level the valve spring 21 is substantially relaxed and as a result the movable valve member 20 provides virtually no resistance to the flow of the fuel in the output channel 19. The pressure control valve 11 accordingly functions virtually unaffected by any factors, with a constant fuel quantity flowing out via the throttle 17. Now, as soon as the engine, installed for instance in a motor vehicle, reaches a different altitude, that is, as soon as the external pressure decreases, the valve spring 21 undergoes an increase of initial tension as a result of the relaxing function of the barometric box and the valve spring 21 exerts resistance against the outflow of the outflow channel 19. This resistance effects an increase of the pressure in the spring chamber 18 and thus reduces the spill cross section 15 of the pressure control valve 11. This, in turn, effects an increase of the pressure in the suction chamber 8 of the injection pump or the work chamber 4 of the pressure control valve 11, as a result of which a variation of the injection onset occurs toward "early".

Figure 3:
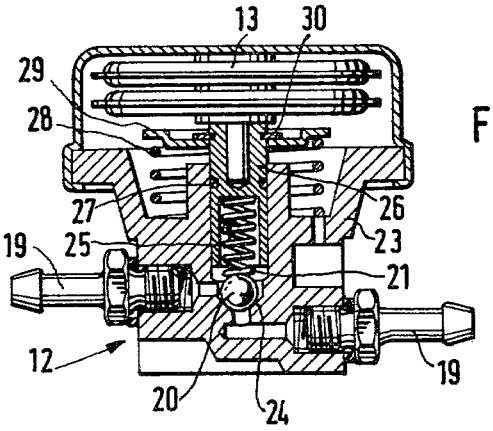
FIG. 3 is a cross-sectional view of a barometric valve of the type used in this invention.

In FIG. 3, a barometric valve 12 in accordance with the invention is shown in a structural embodiment. In the housing 23, a valve seat 24 is provided with which the movable valve member 20 cooperates, which in turn is under the force of the valve spring 21. The valve spring 21 is supported at the rear on the end wall of a blind bore 25 of a slide 26. The slide 26 is axially guided, sealing in a radial manner, in a housing 23 via a seal 27 and is displaceable by means of the barometric box 13. The opening pressure of the pressure maintenance valve 12 thus depends on the position of the slide 26, which is determined by the barometric box 13. The barometric box 13 functions counter to a support spring 28, which is supported on the one end on the housing 23 and on the other end on a spring plate 29, which engages the slide 26 via a securing ring 30. The spring force of the support spring 28 is approximately ten times as great as that of the valve spring 21. As a result, it is attained, on the one hand, that the adjustment unit comprising barometric box 13, piston 26 and spring 28 functions substantially independently of the work pressures of the pressure maintenance valve 12 and, on the other hand, it is by this means attainable that the valve spring 21 can be relieved to such an extent that the pressure maintenance valve 12 is virtually relieved of pressure; in other words, the fuel can flow virtually unthrottled through the outflow channel 19.

In accordance with the invention, it is also possible to switch the pressure maintenance valve 12 parallel to the pressure control valve 11.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. A fuel injection pump for internal combustion engines having a piston adjustable counter to a restoring force by means of fluid from a supply pump in proportion to rpm for adjusting injection onset and having rpm-proportional control of the fluid pressure via a pressure control valve, a control piston displaceable between a pressure chamber and a restoring chamber counter to a restoring force and arranged to determine a spill cross section, and a pressure valve, said pressure valve arranged to influence the fluid pressure in accordance with operational characteristics of the engine and further having at least one valve spring, characterized in that said pressure valve includes a pressure actuated maintenance valve having an opening pressure, said opening pressure arranged to be established by means of varying the initial tension of said valve spring, which is supported on a stop means, said stop means being displaceable in accordance with the air pressure via a barometric box.

2. A fuel injection pump as defined by claim 1, characterized in that said pressure control valve further includes a throttle connection in communication with said spill area, and a spring chamber, said spring chamber leading to a controlled discharge channel and further that said pressure maintenance valve is inserted into said discharge actuated channel.

3. A fuel injection pump as defined by claim 1, characterized in that said stop means includes a slide guided in a housing of said pressure actuated maintenance valve in a radially sealing manner, the side remote from said valve spring of said slide being engaged by the barometric box which comprises at least one element.

4. A fuel injection pump as defined by claim 3, characterized in that said slide is engaged via an abutment by a support spring which in turn is supported on said housing, said spring further arranged to act counter to the force of the barometric box.

5. A fuel injection pump as defined by claim 4, characterized in that said spring is supported in juxtaposition relative to said barometric box by means secured to said slide.

6. A fuel injection pump as defined by claim 4, characterized in that the initial tension of said valve spring can be reduced to 0 by means of the support spring where the external pressure is high.

* * * * *